US010480271B2

(12) United States Patent
Al-Badran

(10) Patent No.: US 10,480,271 B2
(45) Date of Patent: Nov. 19, 2019

(54) MAT FOR WELLHEAD CELLAR

(71) Applicant: Saudi Arabian Oil Company, Dharan (SA)

(72) Inventor: Mohammad Saud Al-Badran, Dhahran (SA)

(73) Assignee: Saudi Arabian Oil Company (SA)

( * ) Notice: Subject to any disclaimer, the term of this patent is extended or adjusted under 35 U.S.C. 154(b) by 89 days.

(21) Appl. No.: 15/157,002

(22) Filed: May 17, 2016

(65) Prior Publication Data

US 2017/0335648 A1 Nov. 23, 2017

(51) Int. Cl.
*E21B 33/03* (2006.01)
*E21B 33/02* (2006.01)

(52) U.S. Cl.
CPC ..... *E21B 33/03* (2013.01); *E21B 33/02* (2013.01)

(58) Field of Classification Search
CPC ..... E21B 33/03
See application file for complete search history.

(56) References Cited

U.S. PATENT DOCUMENTS

| | | | | |
|---|---|---|---|---|
| 509,820 A | | 11/1893 | Naset | |
| 1,507,628 A | | 6/1922 | Schuyler | |
| 3,524,504 A | * | 8/1970 | Allen | E21B 43/24 166/303 |
| 3,550,696 A | * | 12/1970 | Kenneday | E21B 21/08 166/75.11 |
| 4,335,740 A | * | 6/1982 | Boley | E02D 29/12 137/364 |
| 5,477,920 A | * | 12/1995 | Simmons | E21B 33/08 166/81.1 |
| 5,634,485 A | | 6/1997 | Holtby | |
| 6,286,593 B1 | | 9/2001 | Holtby | |
| 6,386,225 B1 | | 5/2002 | Holtby | |
| 6,415,861 B1 | | 7/2002 | Harrison, Jr. | |
| 7,637,692 B1 | | 12/2009 | Rose | |
| 7,987,904 B1 | * | 8/2011 | Rose | E21B 43/0122 166/381 |

(Continued)

FOREIGN PATENT DOCUMENTS

| | | |
|---|---|---|
| CN | 103046890 A | 4/2013 |
| CN | 203626748 U | 6/2014 |

OTHER PUBLICATIONS

International Search Report and Written Opinion for related PCT Application PCT/US2017/033081 dated Sep. 8, 2017.

*Primary Examiner* — Giovanna C Wright
*Assistant Examiner* — Yanick A Akaragwe
(74) *Attorney, Agent, or Firm* — Bracewell LLP; Constance G. Rhebergen

(57) ABSTRACT

A system and method for covering a cellar at a wellhead to prevent and control fluids and gases from the cellar. The covering includes a mat that circumscribes a wellhead tubular that projects upward from the cellar. A split seam in the mat extends radially from the opening to the mat outer periphery which allows the mat to be placed around the wellhead tubular. A fastener joins the ends of the mat that meet at the split seam. The mat includes a collar, which mounts to the mat along the opening and extends axially away from an upper surface of the mat. The collar is secured to the wellhead tabular with a strap. Two discharge lines project through the mat into the cellar, one for pumping into the cellar, and one for withdrawing fluid that has collected in the cellar.

19 Claims, 3 Drawing Sheets

(56) References Cited

U.S. PATENT DOCUMENTS

| | | | | |
|---|---|---|---|---|
| 8,127,937 | B2 | 3/2012 | Liu et al. | |
| 8,770,273 | B1 | 7/2014 | Gibson | |
| 2003/0070813 | A1* | 4/2003 | Irwin, Jr. | E21B 43/122 166/372 |
| 2012/0111572 | A1 | 5/2012 | Cargol, Jr. | |
| 2013/0277056 | A1 | 10/2013 | Dunlavy | |
| 2014/0262314 | A1 | 9/2014 | Ray et al. | |
| 2015/0101831 | A1 | 4/2015 | Dugas et al. | |
| 2016/0069162 | A1* | 3/2016 | Lynch | E21B 33/03 405/52 |

* cited by examiner

FLUID SOURCE
STORAGE TANK
10
14
16
28
47
49
50
51
52
53
64
66
68
69₁
69₂
69₃
69₄
70
71
72
73
74
75
76
78

FIG. 3
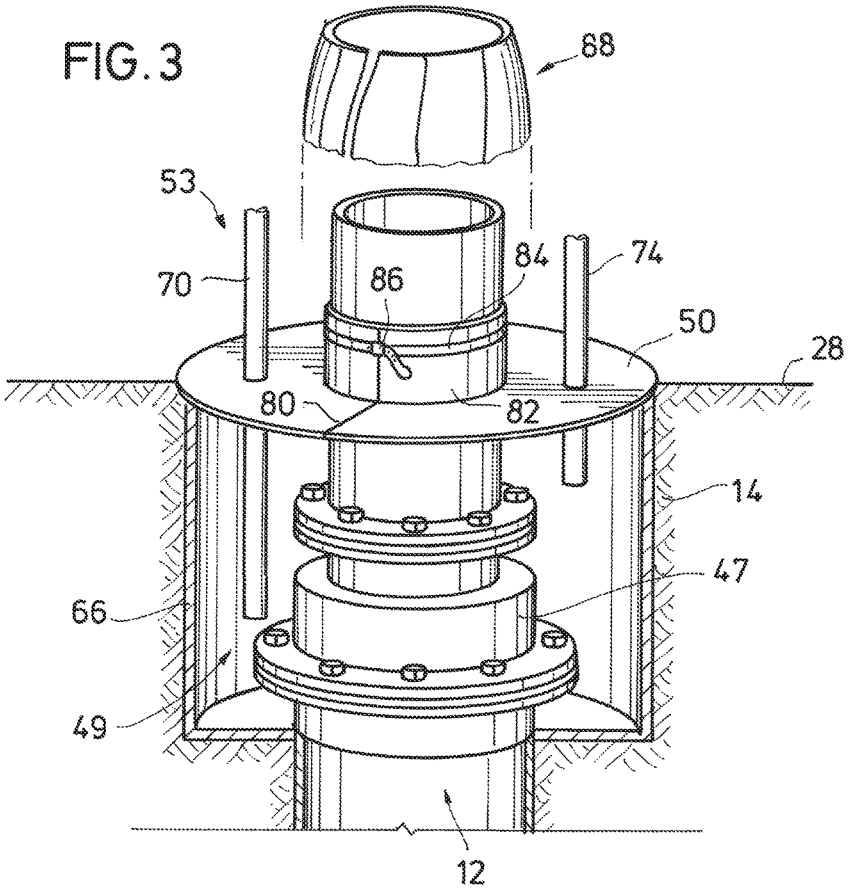
FIG. 4A
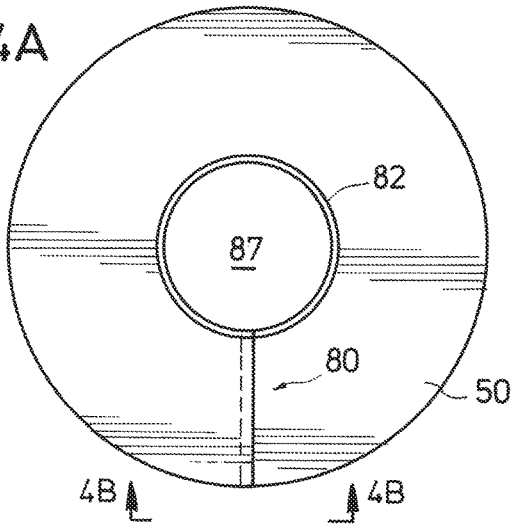
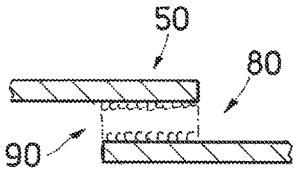
FIG. 4B

MAT FOR WELLHEAD CELLAR

BACKGROUND OF THE INVENTION

1. Field of the Invention

The present disclosure relates to a method and system for blocking fluid flow to the Earth's surface through a wellhead cellar and removing fluid from the wellhead cellar.

2. Description of Prior Art

Hydrocarbon producing wellbores extend subsurface and intersect subterranean formations where hydrocarbons are trapped. Completing the wellbores with casing and tubing allows conduits for the hydrocarbons to be produced to surface Earth boring drill bits are typically used to form the wellbores, which mount on ends of drill strings. Motorized drive systems on surface rotate the drill strings and bits, that in turn crush the rock. Cutting elements on the drill bit scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore.

During the time the wellbore is being drilled, the wellhead assembly usually is made up of a wellhead housing mounted over conductor pipe, where the conductor pipe lines an upper portion of the wellbore. A blow out prevented ("BOP") is typically mounted on an upper end of the wellhead housing. A cellar is often formed around an upper end of gas, water, and oil wells, and that extends into the ground and a few feet below the Earth's surface. The cellar is typically lined with sheet metal, fiberglass, or concrete to collect fluids leaking from wellhead equipment or that has spilled around the wellhead. The fluids can be drilling fluid, oil, lubricants, or completion fluids. Without a cellar, the leaking/spilled fluids might otherwise contaminate the ground around the well. Wellhead cellars are also used as a workspace for operations personnel to access valves and other fluids handling equipment associated with the wellhead assembly. Currently, fluids leaking into the cellar are not controlled, which presents a hazard if the inflow of leaking fluids cannot be stopped. If the flow is excessive, remedial options include igniting the leaking fluids.

SUMMARY OF THE INVENTION

Disclosed herein is an example of a wellbore production facility which includes a wellhead assembly mounted over a hydrocarbon producing wellbore, a cellar circumscribing m upper portion of the wellbore, a mat covering the cellar and circumscribing an outer surface of the wellhead assembly, and a discharge line extending through the mat and having an inlet in fluid communication with the cellar, so that when fluid collects in the cellar, the fluid is selectively drawn into the inlet of the discharge line and removed from the cellar. The facility can further include a storage tank in fluid communication with an end of the discharge line that is distal from the inlet. A vest can optionally be formed in the mat to allow an inflow of mud to replace the space left vacant by the collected fluid being discharged from the cellar or to push the fluid out of the cellar. In this example, the vent includes a vent line having an end that terminates in the cellar and that is in fluid communication with the cellar, and an opposite end in communication with a fluid source. In an example the mat further includes a collar that mounts along an opening in the mat, and wherein the wellhead assembly inserts through the opening. The collar can be strapped to the outer surface of the wellhead assembly. A skirt can be included that covers the collar. The outer circumference of the mat can include a metal ring, that can optionally be connected to the cellar to provide a seal between the mat and the ground. The mat can further include a split seam that extends from the opening to an outer periphery of the mat so that the mat can fit around the wellhead assembly. In one embodiment, the wellhead assembly includes conductor pipe, wellhead housing, and a blowout preventer.

Also described herein is an example of a wellbore production facility which includes a wellhead assembly mounted over and in fluid communication with a wellbore, a cellar circumscribing an upper portion of the wellbore and that is intersected by a portion of the wellhead assembly, a coveting ever the cellar, and a fluid discharge system coupled with the covering and that is in fluid communication with the cellar and which selectively discharges fluid collected in the cellar. The covering can be a self-supporting mat with an outer periphery that rests on a surface of the Earth that is penetrated by the wellbore. The facility can further include a means for sealing an interface between the covering and an outer surface of the wellhead assembly. Also optionally included is a vent system that penetrates the covering and flows a volume of fluid into the cellar to replace a volume of fluid discharged through the fluid discharge system.

Further described herein is a method of operating a well bore and that includes maintaining a cover over a cellar formed adjacent an opening of the wellbore, and discharging fluid collected in the cellar through a discharge line that is routed through the cover. The method can further involve venting into the cellar through the cover to replace a volume of space in the cellar that was occupied by the fluid discharged from the cellar. The step of discharging fluid can include directing the fluid collected in the cellar to a storage tank. The cover can interface with an outer surface of a portion of a wellhead assembly, and the method can further Include providing a seal between the cover, wellhead, assembly, and surface. The fluid collected in the cellar can be liquid, gas, or a combination.

BRIEF DESCRIPTION OF DRAWINGS

Some of the features and benefits of the present invention Shaving been stated, others will become apparent in the description proceeds when taken in conjunction with the accompanying drawings, in which;

FIG. 3 is a side perspective view of an alternate embodiment of the mat of FIG. 2.

FIG. 4A is an overhead view of the mat of FIG. 3.

FIG. 4B is a side sectional view of the mat of FIG. 4A taken along lines 4B-4B.

Figure 1:
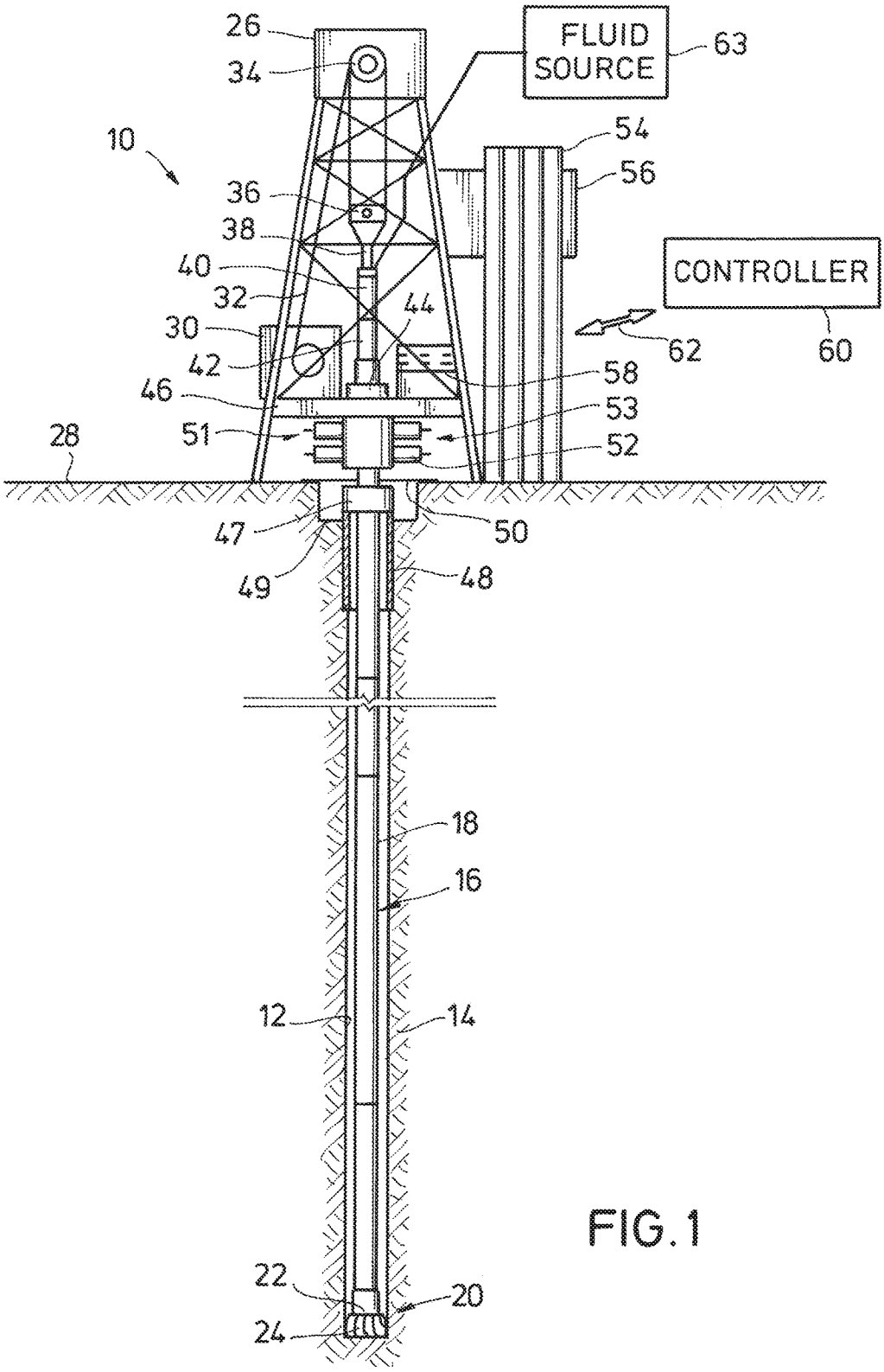
FIG. 1 is a side partial sectional view of an example of a drilling system forming a wellbore.

While the invention will be described in connection with the preferred embodiments. It will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a drilling and workover system 10 is shown in a side sectional view in FIG. 1, where drilling system 10 is used for forming a wellbore 12 through a formation 14. Drilling system 10 includes an elongate drill string 16 is shown disposed within wellbore 12 and made up of segments of drill pipe 18. In one example, the segments of drill pipe 18 are threadingly coupled to one another. A drill bit 20 is illustrated mounted on a lower end of drill string 16, and which includes a bit body 22 that threadingly mounts on a lowermost one of the drill pipes 18 of the drill string 16. Inserts or cutters 24 are shown on a surface of drill bit body 22 opposite from where it attaches to drill string 16. When the string 16 and bit 20 are rotated, the cutters 24 crush the rock making up the formation 14 thereby forming borehole 12.

An example of a derrick 26 is depicted above an opening of wellbore 12 and mounted on surface 28. Embodiments of equipment for manipulating the drill string 16 are shown included with derrick 26, and which includes a drawworks 30. The drawworks 30 selectively pull or release a cable 32 shown engaging sheaves 34 that are rotatingly mounted on an upper end of derrick 26. Additional cables ran through the sheaves 34, and which on a lower end support a traveling block 36, that in conjunction with a hook 38 and swivel 40, couple with drill string 16 for raising and lowering drill string 16. A kelly 42 axially engages a lower end of swivel 40; and is rotatable with respect to swivel 40. A lower end of kelly 42 projects through a rotary table 44, which meshes with outer surfaces of kelly 42 and rotates to exert a rotational force onto kelly 42 and to drill string 16. Rotary table 44 is formed on a platform 46 that attaches to derrick 26, and is set above surface 28. Drawworks 30 are shown mounted on platform 46.

Below platform 46 is a wellhead housing 47 that is mounted on conductor pipe 48 shown inserted in the opening of wellbore 12. The wellhead housing 47 is disposed within a cellar 49 that extends downward from the surface 28 and circumscribes an upper end of the wellborn 12. A mat 50 is shown covering the open upper surface of the cellar 49. On top of the wellhead housing 47 is a blowout preventer ("BOP") 51 and through which segments of the drill pipe 18 are inserted after being coupled with kelly 42. Rams 52 mount on lateral sides of BOP 51 and are equipped with blades (not shown) that can selectively sever the pipe string 16 and also form a safety barrier in the event wellbore 12 needs to be shut-in during emergency situations. The combination of the BOP 51, wellhead housing 47, and tubulars coupled to the BOP 51 and wellhead housing 47 define an example of a wellhead assembly 53.

Further shown on surface 28 are stands of pipe 54 that are supported by a tack 56 illustrated on one of the side beams of derrick 26. Also on platform 46 is a driller's console 58 having gauges representing downhole conditions, and controls for operating the drilling assembly 10; such as the drawworks 30. Schematically illustrated is a controller 60 having a communication means 62 to provide communication between controller 60 and console 58. Communications means 62 can be wireless, fiber optic, or made up of electrically conducting material. Embodiments exist wherein controller 60 is included, within console 58. Drilling fluid for use in terming the wellbore 12 is shown being supplied from a fluid source 63.

Figure 2:
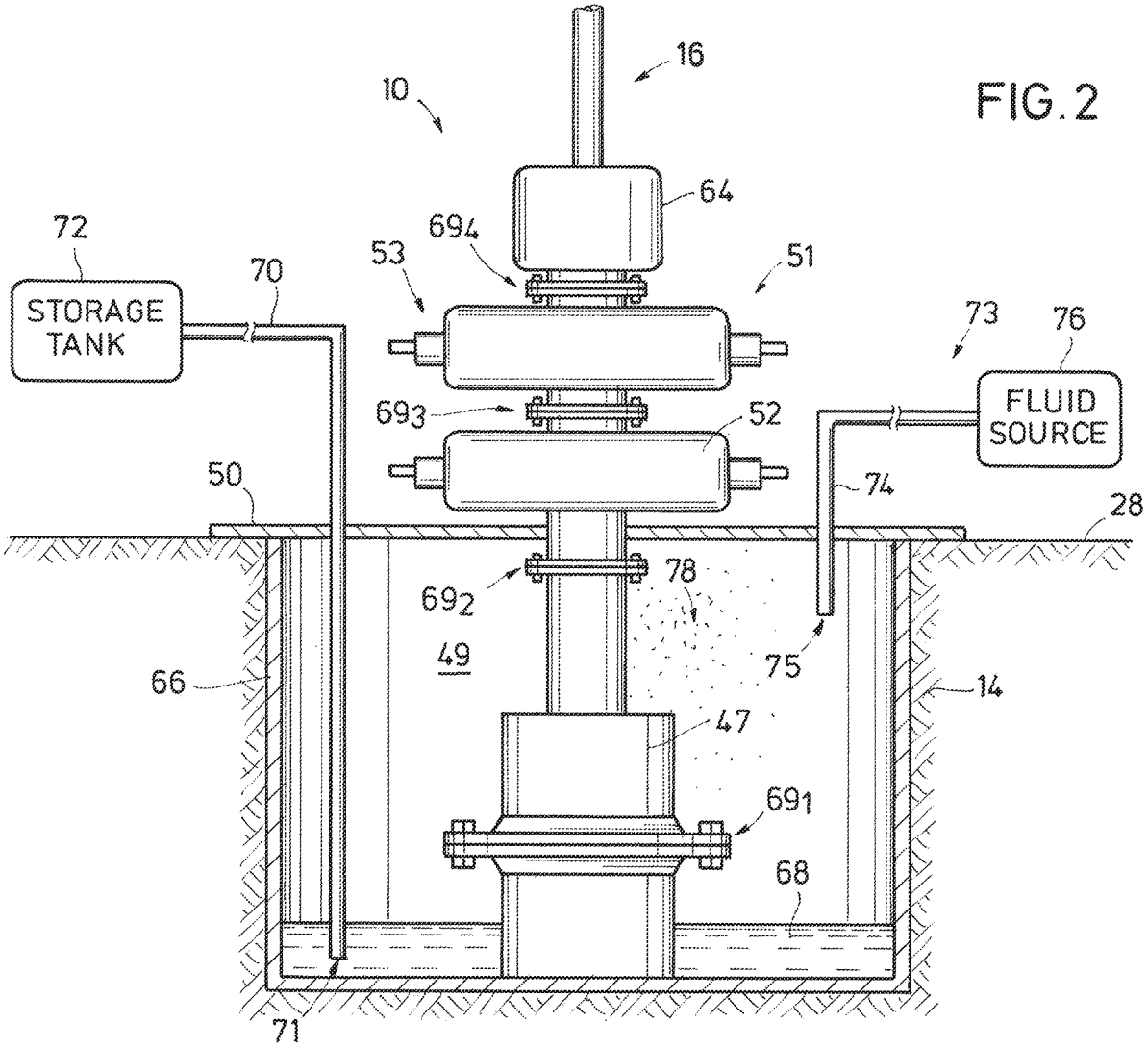
FIG. 2 is a side partial sectional view of an example of a portion of the drilling system of FIG. 1 having a cellar and an example of a mat over the cellar.

Shown in FIG. 2 in side partial sectional view is a portion of an example of the drilling system 10 of FIG. 1. Here the mat 50 is shown extending over the upper end of the cellar 49. Without the presence of mat 50, cellar 49 would have an open end at surface 28 and free to receive any fluids that may leak from wellhead assembly 53 or spilled thereon, or send to surface and to the atmosphere any fluids or gasses that leak from the well through the casing-casing annuli where channels and micro channels may develop in the cement or through corroded casing below the Earth's surface. Examples of leaked fluids include crude oil, natural gas, CO2 and H2S. One example of spilled fluids includes drilling mud or drilling fluids (not shown) that flow through drill string 16. Further illustrated in FIG. 2 is an annular ram 64 that is part of the BOP 51 and shown mounted above the rams 52. A liner 66 is shown provided along the outer periphery and bottom of cellar 49 and provides a support means so that the formation 14 adjacent cellar 49 does not collapse into the space occupied by cellar 49. Examples of the liner 66 can be sheet metal, brick, concrete, polymers, and the like, and combinations thereof.

Further shown in FIG. 2, is an amount of liquid 68 which has collected in the bottom of cellar 49 and retained therein by liner 66. As indicated above, a source of the liquid 68 can be from spills, or from leaks between flanges $\mathbf{69}_1$-$\mathbf{69}_4$ shown provided along wellhead assembly 53, such as on wellhead housing 47 and its connection to BOP 51. Optionally, fluid can migrate upward from within wellborn 12 (FIG. 1) which is below wellhead housing 47 through corroded casing or micro channels develop in the cement in the casing-casing annuli. To handle the liquid 68 a discharge line 70 is shown depending into cellar 49 and penetrating through mat 50. An end of discharge line 70, opposite its inlet 71 which is shown below the surface of liquid 68 connects to a storage tank 72 wherein the liquid 68 can be relocated to and stored therein. To avoid a pressure differential across mat 50, a vent system 73 is shown which includes a vent line 74 that also penetrates through mat 50. Discharge 75 of vent line is disposed within cellar 49, and an end of vent line 74 opposite form its discharge 75 connects to a fluid source 76. In an example, fluid source 76 is a source of air to flow into cellar 49 and replace the volume of space in cellar 49 vacated by the liquid 68 being discharged from cellar 49. Optionally, vent line 74 may simply be open to the ambient space outside of cellar 49 and so that differential pressures alone may be drawn in and vent air into cellar 49. Optionally, the fluid that collects within cellar 49 can be a gas 78 which in some instances may be flammable and therefore desirable to remove from within cellar 49. In this example, fluid source 76 can include an inert gas and positive pressure can be inserted into cellar 49 which forces the flammable gas 78 through discharge line 70 and to be routed away from cellar 49.

FIG. 3 shows in a side partial sectional perspective view an example of the portion of wellhead assembly 53 mounted over wellbore 12 and disposed within cellar 49. In the example of FIG. 3, the cover or mat 50 is shown having a split seam 80 which projects radially inward from an outer periphery of mat 50 and to a collar 82 which projects axially away from an upper surface of mat 50 and along a portion of the outer surface of wellhead assembly 53. A strap 84 secures collar 82 to wellhead assembly 53 so that fluid possibly spilled on the wellhead assembly 53 will not flow downward into cellar 49, but stay on the mat 50 where it can be reclaimed via suitable measures. Thus, collar 82 defines a seal between mat 50 and outer surface of wellhead assembly 53. In the example of FIG. 3, a strap 84 wraps around collar 82 to secure collar 82 to wellhead assembly 53. A cinch or buckle 86 provides a way of maintaining tension within strap 84 around wellhead assembly 53. Optionally, a skirt 88 is shown which can be a fabric or other pliable material and which optionally fits around wellhead assembly 53 and over the strap 84 thereby protecting strap 84 and/or collar 82 from contamination and other damage.

FIG. 4A is a plan view of an example of mat 50 illustrating how split seam 80 extends radially from within an opening 87 formed in mat 50, and which in this example defines an inner periphery of mat 50. Moreover, collar 82 is shown mounted to mat 50 along the opening 87. FIG. 4B illustrates one example of how the opposing ends of mat 50 that join at split seam 80 can be joined together. In one example, fasteners 90 are shown mounted on the respective lower and upper surfaces of the ends of the mat 50. In one example, fasteners 90 can be made up of traditional hook and loop fasteners. Other examples of fasteners 90 include snaps, pins, zippers, and the like.

Advantages of the mat 50 are that it is removable and can be placed on different wellheads, and that it isolates low pressure leaks below the wellhead that may occur in the cellar 49 during the entire well life cycle. Additionally, the discharge and vein lines 70, 74 provide for circulation through the cellar 49 that maintains a cellar 49 that is substantially free of undesirable fluids within. Examples of undesirable fluids include those that are flammable, corrosive, and/or toxic. In one embodiment, the mat 50 is heavy and/or rigid enough to settle over and cover the cellar 49 during operations without additional support. Examples of material making up the mat 50 include elastomers, fabrics, such as heavy canvas, composites, and combinations thereof. In an alternative, the material for the mat 50 is corrosion resistant. In one example of installation, the mat 50 is fitted around the wellhead assembly 55, then the split seam 80 closed, then the collar 84 is cinched into place. The collar 82 can be raised or lowered to match the characteristics of the particular wellhead assembly 53 on which it is mounted. Moreover, this allows work to be performed on the entire wellhead assembly 53 by setting a height of the collar 84 that is appropriate for the specific application. In an example, a periphery of the mat 50 connects to the cellar 49; or lies on surface 28 with a metal ring to seal the other end of the mat 50. Types of fluid that could be handled by the discharge line include fluid that is produced from within the formation 14 and through the wellbore 12, drilling mud that may be used in conjunction with drilling the wellbore 12, completion fluids, or any other type of fluid that may be present at a wellsite. In one example of operation, the third circulated between the vent line 74 and discharge line 70 can continue until a leak that is the source of the fluids flowing into cellar 49 can be isolated and repaired. In low pressure applications, the weight of the mat 50 can maintain fluid within cellar 49 and prevent egress outside of cellar 49 but instead, the fluid can be routed via the discharge line 70. In additional to being used during drilling, mat 50 can also be used during workover operations, and other well service operations throughout the entire well life cycle.

The present invention described herein, therefore, is well adapted to carry out the objects and attain the ends and advantages mentioned, as well as other inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellbore production facility comprising:

a wellhead assembly mounted over a hydrocarbon producing wellbore;

a cellar comprising a bottom, sidewalls extending from the bottom to the Earth's surface and that circumscribe an upper portion of the wellbore, and an open upper end;

a planar mat covering the cellar comprising an upper surface, a lower surface facing the cellar, an opening extending between the upper and lower surfaces and which defines an inner periphery that circumscribes an outer surface of the wellhead assembly, an outer periphery set over ends of the sidewalls distal from the bottom, the mat formed from an elastomeric material with a rigidity so that the mat spans between the inner and outer peripheries while retaining liquid spillage on the upper surface without additional support;

a sealing interface between the mat and the wellhead assembly and another sealing interface between the mat and the Earth's surface for isolating a fluid leak in the cellar;

a discharge line extending through the mat and having an inlet in fluid communication with the cellar, so that when fluid leak in the cellar, the fluid is selectively drawn into the inlet of the discharge line and removed from the cellar; and a vent line intersecting the mat, having a discharge disposed in the cellar, and from which a quantity of gas selectively exits the vent line and flows into the cellar.

2. The wellbore production facility of claim 1, further comprising a storage tank in fluid communication with an end of the discharge line that is distal from the inlet, and that selectively receives fluid collected within the cellar that flows through the discharge line.

3. The wellbore production facility of claim 1, wherein the vent line is part of a vent system, that further comprises a fluid source connected to an end of the vent line outside of the cellar and from which fluid is provided that occupies a space in the cellar to replace the space left vacant by the collected fluid being discharged from the cellar.

4. The wellbore production facility of claim 3, wherein the fluid source comprises an ambient space outside of cellar.

5. The wellbore production facility of claim 1, wherein the vent line is part of a vent system that further comprises a fluid source that selectively communicates pressurized inert gas to the vent line, and where the inert gas is transmitted to the cellar via the vent line at a pressure to force gas inside the cellar through the discharge line and away from the cellar.

6. The wellbore production facility of claim 1, further comprising a metal ring disposed over an outer portion of the mat and which provides a seal between the mat and the cellar.

7. The wellbore production facility of claim 1, wherein the mat is self-supporting and covers the cellar without additional support, and wherein fluid flows through the vent line in response to a pressure differential across the mat and to a side of the mat that is at a lower pressure than an opposing side of the mat.

8. The wellbore production facility of claim 1, wherein the mat attaches to the cellar.

9. The wellbore production facility of claim 1, wherein the wellhead assembly comprises conductor pipe, wellhead housing, and a blowout preventer.

10. A wellbore production facility comprising:

a wellhead assembly mounted over and in fluid communication with a wellbore;

a cellar circumscribing an upper portion of the wellbore and that is intersected by a portion of the wellhead assembly;

covering over the cellar comprising an elastomeric mat having an upper surface facing the wellhead assembly, a lower surface facing the cellar, and a thickness and rigidity to self supportingly span between the wellhead assembly and an outer periphery of the cellar when liquid spillage is on the upper surface, and for providing an interface with the cellar to form a barrier to isolate leaks of fluid in the cellar;

a means for avoiding a pressure differential across the covering that comprises a vent line that intersects the covering, and that provides fluid communication between a fluid source outside of the collar and a space inside the cellar; and a fluid discharge system coupled with the covering and that is in fluid communication with the cellar and which selectively discharges fluid collected in the cellar.

11. The wellbore production facility of claim 10, wherein the covering comprises a self-supporting mat with an outer periphery that rests on a surface of the Earth that is penetrated by the wellbore.

12. The wellbore production facility of claim 10, wherein the covering attaches to the cellar.

13. The wellbore production facility of claim 10, further comprising a ring set on an outer radial portion of the covering circumscribing the cellar, and which defines a seal between the covering and the cellar.

14. A method of operating a wellbore comprising:

providing a cover for a cellar formed adjacent an opening of the wellbore, the cover comprising an elastomeric material that is self-supporting;

isolating a fluid leak within the cellar by placing the cover over the cellar, providing a seal between the cover and a wellhead assembly mounted to the wellbore, and providing a seal between the cover and an outer periphery of the cellar;

collecting fluid leaking from the wellhead assembly on an upper surface of the cover;

discharging fluid collected in the cellar through a discharge line that is routed through the cover; and avoiding a pressure differential across the cover by communicating a venting fluid into the cellar with a vent line that is routed through the cover.

15. The method of claim 14, wherein the fluid communicated into the cellar through the cover replaces a volume of space in the cellar that was occupied by the fluid discharged from the cellar.

16. The method of claim 14, wherein the step of discharging fluid comprises directing the fluid collected in the cellar to a storage tank.

17. The method of claim 14, wherein the cover interfaces with an outer surface of a portion of a wellhead assembly, the method further comprising providing a seal between the cover and wellhead assembly by disposing a ring along an outer periphery of the cover.

18. The method of claim 14, wherein the fluid collected in the cellar and discharged through the discharge line comprises liquid, gas, and a combination of liquid and gas.

19. The method of claim 14, wherein the fluid communicated into the cellar comprises an inert gas, the method further comprising forcing fluid through the discharge line with the inert gas.

* * * * *